United States Patent [19]

Tsuji

[11] Patent Number: 4,881,903

[45] Date of Patent: Nov. 21, 1989

[54] TERMINAL CONNECTOR OF SMALL ELECTRIC DEVICES

[75] Inventor: Yoshitaka Tsuji, Osaka, Japan

[73] Assignee: IDEC IZUMI Corporation, Osaka, Japan

[21] Appl. No.: 236,392

[22] Filed: Aug. 25, 1988

[30] Foreign Application Priority Data

Aug. 26, 1987 [JP] Japan ..... 62-129801[U]

[51] Int. Cl.[4] ..... H01R 9/24

[52] U.S. Cl. ..... 439/76; 439/712; 439/812

[58] Field of Search ..... 439/189, 709, 711, 712, 439/811, 812, 76

[56] References Cited

U.S. PATENT DOCUMENTS 1,836,951 12/1931 Blakeslee ..... 439/712

4,519,668 5/1985 Fujita et al. ..... 439/775

4,542,953 9/1985 Iwamoto et al. ..... 439/717

4,650,272 3/1987 Doughty et al. ..... 439/712

*Primary Examiner*—Gary F. Paumen

*Attorney, Agent, or Firm*—Pollock, Vande Sande & Priddy

[57] ABSTRACT

A small electric device accommodating therein a printed substrate having electric circuitry and employing terminal connecting devices for connecting electric wires from external devices to terminals on the printed substrate, the terminal connecting devices being fastened to a terminal section of a holding member. Positions of the terminals on the substrate and mounting positions of the corresponding terminal connecting devices are so arranged that the terminals on the substrate and portions of the terminal connecting devices are brought into contact and are connected electrically upon assembly of the substrate and the holding member.

7 Claims, 2 Drawing Sheets

TERMINAL CONNECTOR OF SMALL ELECTRIC DEVICES

BACKGROUND OF THE INVENTION

1. Field of the Invention

The present invention relates to small electric devices having input and output terminal sections, such as a photoelectric switch, and more particularly to a terminal connector of small electric devices, which has a simplified construction of connecting external lines with terminals in a substrate having internal circuits and therefore making an easy assembling of the devices possible.

2. Description of the Related Art

Generally, when connecting an electric wire 60 to a small electric device, a metal terminal member 61, as shown in FIG. 4, is fitted on an end of the electric wire 60 and the terminal member 61 is fastened to the terminal holder of the electric device. The terminal holder includes a terminal plate and a terminal screw to be fitted in the terminal plate, and in the situation that the terminal screw 62 is removed temporarily from the terminal plate, the terminal member 61 is arranged on the terminal plate and the terminal screw 62 is inserted through the hole of the terminal member 61, thereby fastening the terminal member 61 to the terminal plate. To remove the terminal screw 62 from the terminal plate whenever the terminal member is fastened to the terminal holder as just described has the disadvantage of not only complicating the operation but also causing the loss of the terminal screw.

To eliminate the above disadvantages, the applicant has invented a terminal connecting device of the type in which a terminal screw is movably arranged with respect to the corresponding terminal plate and moreover the terminal screw is made stationary with a gap formed between it and the terminal plate as disclosed in U.S. Pat. Nos. 4,519,668 and 4,542,953. With the terminal connecting device constructed as described, when fastening a terminal member at the end of an electric wire to a terminal holder, with a terminal screw held stationary so as to form a gap between it and a terminal plate, the terminal member is arranged on the terminal plate and in this condition the terminal screw is moved, thereby eliminating the need to completely remove the terminal screw from the terminal plate, simplifying the fastening operation of the terminal member and preventing the terminal screw from being lost.

Incidentally, there have been no conventional electric devices which have given consideration to a construction for connecting simply the terminal connecting device to a circuit substrate on which all of the electric circuits of the electric devices are mounted. Thus, when fastening the terminal connecting device to the electric devices, special wirings are required for providing electric connections between the terminal connecting device and the substrate or a part of a terminal plate forming the terminal portion of the terminal connecting device has been elongated to contact with a terminal on the substrate. Therefore, these constructions have produced disadvantages in that the former complicates the assembling operation of an electric device and the latter increases the production cost of the components.

SUMMARY OF THE INVENTION

It is an object of the present invention to provide a small electric device equipped with a terminal connector which is designed to utilize the special construction of the terminal connecting device in such a manner that when assembling the electric device, some portions of the terminal connecting device are automatically brought into contact with the corresponding terminals formed on the printed circuit substrate, thereby eliminating the need for any special construction and components, and simplifying the assembling operation and furthermore attaining a reduction in cost.

A terminal connector of a small electric device according to the present invention includes, a substrate having electric circuitry arranged thereon and formed with at least one terminal at a given location thereof for electrically connecting the electric circuitry with an external device, a holding member for accommodating the substrate therein and having terminal sections providing locations where electric wires from the external devices are connected to the terminal, and terminal connecting devices for fastening the electric wires, arranged in the terminal section of the holding member and each including a fastening screw, a movable member for supporting the fastening screw, a terminal spring for movably and undetachably supporting the movable member and a terminal fitting, wherein the positions of the terminals on the substrate and the mounting position of the terminal connecting devices are selected in such a manner that when the substrate is accommodated in the holding member and the terminal connecting devices are arranged in the holding member, a positional relation is attained such that each of the terminals on the substrate and a portion of each of the corresponding terminal connecting devices are brought into contact and connected electrically with each other.

In accordance with this invention, a portion of the touch-down type terminal connecting device is brought into contact with the terminal on the substrate during the assembling operation. Also, by employing a construction such that these contacting portions are exposed to the outside, it is possible to easily and positively fasten the terminal connecting device to the substrate by soldering or the like. Consequently, there is no need for a wiring operation using other wires or the like for the connection of the terminal connecting device and the substrate and the assembling operation can be simplified. Moreover, there is no need to extend a part of the terminal connecting device for connection to the terminal on the substrate and the component cost is not increased.

DESCRIPTION OF THE PREFERRED EMBODIMENTS

Figure 2:
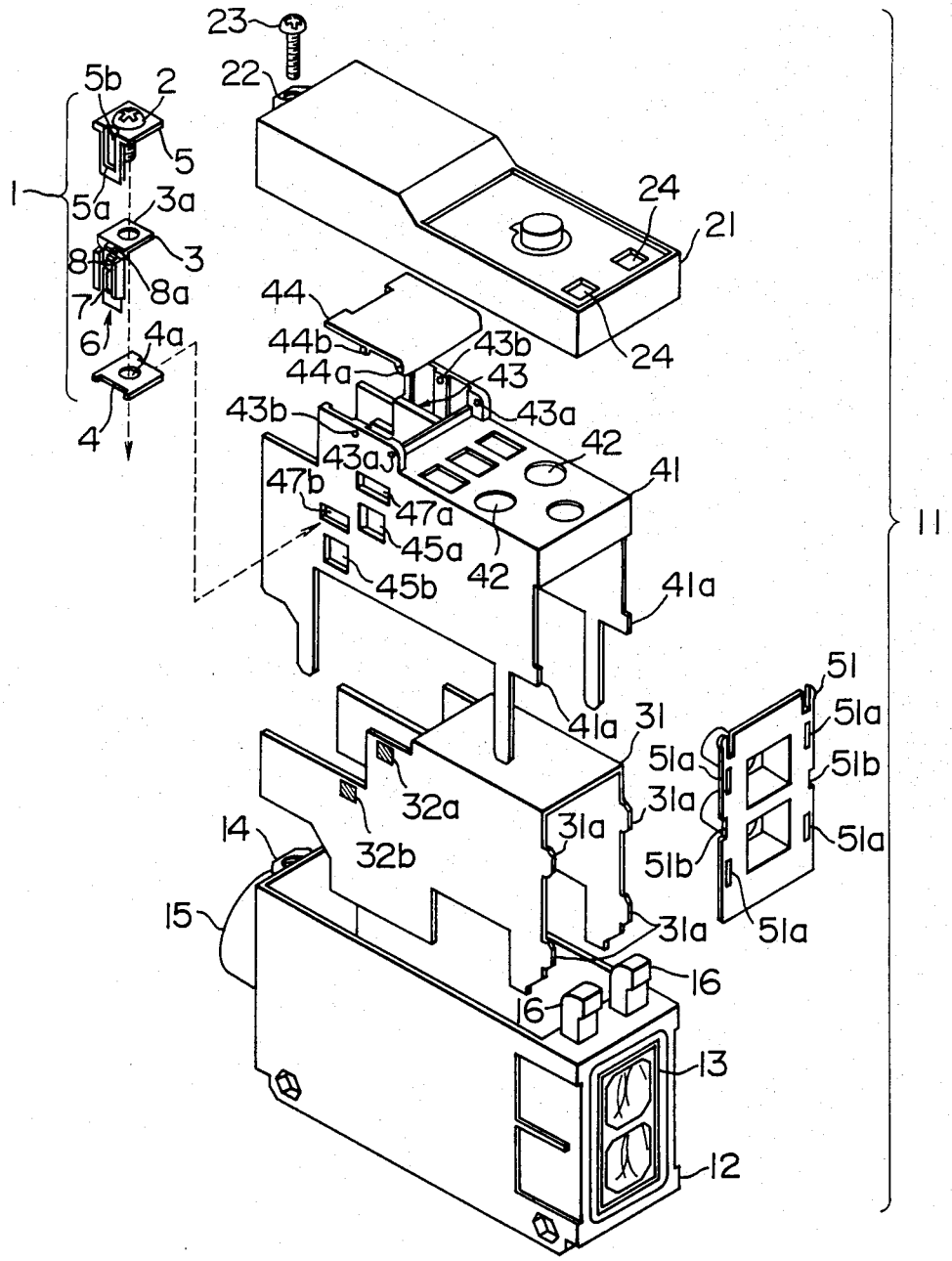
FIG. 2 is an assembling diagram of the photoelectric switch.

An embodiment of the present invention will now be described with reference to a photoelectric switch by way of example. FIG. 2 shows an assembly diagram of the photoelectric switch as an embodiment of the invention.

A photoelectric switch 11 includes a printed substrate 31 having a three dimensional configuration made by folding a sheet material, a holding member 41 made of an insulating material and an element holder 51 within a casing 12. Lenses 13 are mounted on the front face of the casing 12. Formed on the back side of the casing 12 is a wiring hole portion 15 through which electric wirings are passed. A female-type threaded portion 14 is formed on the upper side of the wiring hole portion 15 and a pair of projections 16 is formed on the upper surface of the front portion of the casing 12. Each of the projections 16 engages with the corresponding hole of a pair of holes 24 formed in a cover 21. Also, when assembling the components of the switch 11, the threaded portion 14 in the casing 12 coincides with a threaded hole 22 formed on the rear side of the cover 21 in their positional relationship. Thus, after the projections 16 have been engaged with the holes 24, a fastening screw 23 is finally engaged with the threaded portion 14 through the threaded hole 22, thereby installing the cover 21 on the upper side of the casing 12.

Projections 31*a* are formed, each at one of four locations on the front of the substrate 31. Each of the projections 31*a* is fitted into the corresponding one of holes formed at four locations of the element holder 51. A cut portion 51*b* is formed on each side of the element holder 51. On the other hand, a pair of projections 41*a* is formed on the front of the holding member 41 and each of the projections 41*a* engages with the corresponding one of the cut portion 51*b*. Its overall width perpendicular to the side wall of the substrate 31 is selected to be substantially the same as the inner width of the holding member 41 perpendicular to its side wall and the substrate 31 is accommodated within the holding member 41 from below. In this condition, the projections 31*a* are fitted in the holes 51*a* and the projections 41*a* are engaged with the cut portions 51*b*, respectively, thereby fastening the element holder 51 to the fronts of the substrate 31 and the holding member 41.

A terminal section 43 is formed on the central portion and the rear portion in the upper part of the holding member 41. Mounted in the terminal section 43 are four so-called touch-down type terminal connecting devices 1, which are arranged, for example, in two rows of two devices in the width direction so as to be positioned at different heights in the longitudinal direction. Also, a pair of turning pivot holes 43*a* and a pair of locking holes 43*b* are formed near to the upper edges of the side wall of the holding member 41 in the terminal section 43. Each of the turning pivot holes 43*a* pivotally supports a projection 44*a* formed on each front portion of both sides of a cover 44 which covers the upper opening of the terminal section 43. Also, a locking projection 44*b* formed on each central portion of both sides of the cover 44 is engaged with the corresponding one of the locking holes 43*b*, thereby covering the upper opening of the terminal section 43 by the cover 44. The necessary indications about the wiring are provided on the back side of the cover 44. A plurality of holes 42 are formed in the upper wall of the holding member 41. An adjusting means (not shown) mounted on the upper surface of the substrate 31 which faces the holes 42 permitting access to operate the adjusting means therethrough. The holding member 41 is also formed on each side wall thereof with a pair of holes 45*a* and 45*b* and a pair of slit holes 47*a* and 47*b*. The holes 45*a* and 45*b* respectively face electric terminals 32*a* and 32*b* used for the circuit on the substrate formed on each side of the substrate 31. Thus, when the substrate 31 is accommodated within the holding member 41, the terminals 32*a* and 32*b* are exposed through the holes 45*a* and 45*b*, respectively.

Each terminal connecting device 1 includes a fastening screw 2 rotatably supported on a movable member 5, a terminal spring 3 having a slide portion 6, and a terminal fitting 4. The fastening screw 2, the terminal spring 3, the terminal fitting 4 and the movable member 5 are made of an electrically conductive material. The movable member 5 is formed with a tongue portion 5*a* extended vertically in the Figure. Also, the terminal spring 3 is formed with the slide portion 6 extended vertically in the Figure. The slide portion 6 is provided with a cut-raised portion 7 including a protuberance 8, and a projection 8*a*. When the terminal spring 3 is placed on the upper surface of the terminal fitting 4, the hole 4*a* of the terminal fitting 4 and the hole 3*a* of the terminal spring 3 are positioned so that the positions of their centers coincide with each other. In this condition, when the tongue portion 5*a* of the movable portion 5 is inserted into the slide portion 6 of the terminal spring 3, the fastening screw 2 is arranged in a position where it fits in the holes 3*a* and 4*a*.

Figure 1:
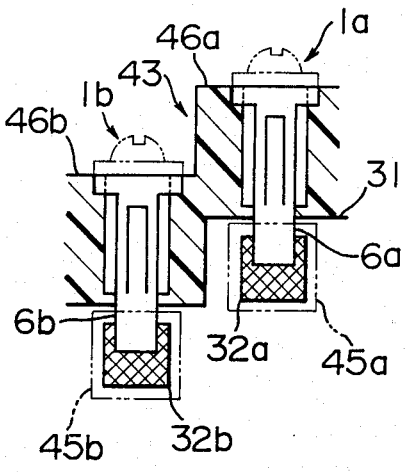
FIG. 1 is a side sectional view showing a principal part of a photoelectric switch as an embodiment of the invention.

Referring to FIG. 1, there is illustrated a side sectional view of a principle part of the holding member 41.

In the holding member 41, the terminal section 43 comprises upper and lower portions which are formed as upper and lower terminal blocks 46*a* and 46*b*. The previously mentioned touch-down type terminal connecting device 1*a* is fastened to the upper terminal block 46*a* and the touch-down type terminal connecting device 1*b* is fastened to the lower terminal block 46*b*. After the terminal connecting devices 1*a* and 1*b* have been fastened to the terminal section 43 of the holding member 41, the substrate 31 having the electric circuitry mounted thereon is accommodated within the holding member 41 so that their slid portions 6*a* and 6*b* are respectively brought into contact with the terminals 32*a* and 32*b* of the substrate 31 due to the mounting positions of the terminal connecting devices 1*a* and 1*b*. At this time, the terminals 32*a* and 32*b* respectively face the holes 45*a* and 45*b*, as mentioned previously, and therefore the contact exists between the terminals 32*a* and 32*b* exposed to the outside through the holes 45*a* and 45*b* of the holding member 41 and the slide portions 6*a* and 6*b* respectively. Thus, during the assembling operation of the photoelectric switch 11, after the four terminal connecting devices 1 have been fastened to the terminal section 43 of the holding member 41, it is possible to accommodate the substrate 31 within the holding member 41 and then fasten the slide portions 6*a* and 6*b* respectively to the terminals 32*a* and 32*b* exposed through the holes 45*a* and 45*b* by soldering or the like.

Figure 3A:
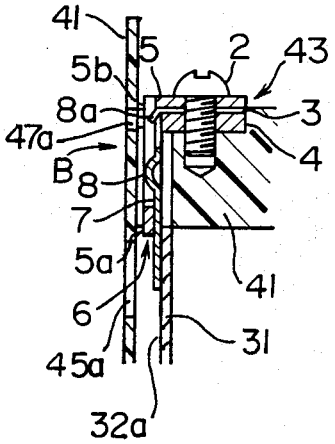
FIGS. 3A and 3B are elevational sectional views of the essential part of the photoelectric switch.
Figure 3B:
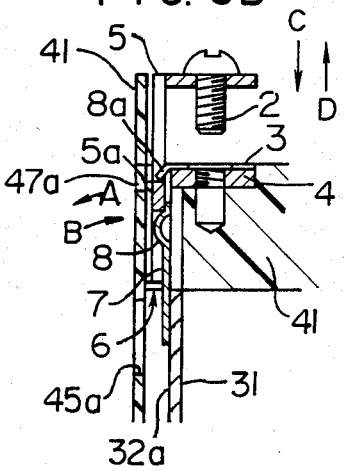
Figure 4:
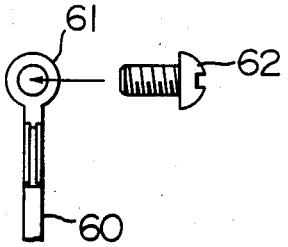
FIG. 4 PRIOR ART
FIG. 4 is a plan view of a terminal member adapted for connecting the electric wire to the terminal section of an ordinary small electric device.

FIGS. 3A and 3B are front sectional views of an essential part of the holding member 41. When fastening the terminal connecting device 1 to the terminal section 43, the terminal fittings 4 are respectively inserted first through the holes 47*a* and 47*b* in the side wall of the holding member 41 (as shown in FIG. 2) and then the terminal springs 3 are placed on the terminal fitting 4 through the upper opening of the terminal section 43. Also, the tongue portion 5*a* of the movable member 5 is engaged with the slide portion 6. In this condition, each fastening screw 2 is tightened so that the fastening screw 2 is engage with the threaded hole 4a of the terminal fitting 4 as shown in FIG. 3A. At this time, the protuberance 8 and the cut-raised portion 7 in the slide portion 6 is positioned, along with the projection 8a, within an elongated hole 5b of the tongue portion 5a.

In the condition shown in FIG. 3A, when the fastening screw 2 is loosened to release the engagement between the fastening screw 2 and the terminal fitting 4 and then the movable member 5 may be moved upward in the direction of an arrow D, the tongue portion 5a comes into contact with the protuberance 8 thus causing the cut-raised portion 7 to temporarily move in the direction of an arrow B. When the protuberance 8 comes into contact with the lower part of the tongue portion 5a, as shown in FIG. 3B, the tongue portion 5a and the protuberance 8 are brought out of contact and the cut-raised portion 7 is moved in the direction of an arrow A by its resilience. At this time, the lower end of the tongue portion 5a is limited in its movement in the direction of an arrow C by the protuberance 8 and its movement in the direction of the arrow D is also limited by the projection 8a. In this connection, a gap of a given distance is produced between the fastening screw 2 and the upper surface of the terminal spring 3. After a terminal member of the wiring has been positioned in the gap, when the fastening screw 2 is pressed, along with the movable member 5 as a guide, in the direction of the arrow C, the cut-raised portion 7 and the protuberance 8 is urged by the lower end of the tongue portion 5a to move in the direction of the arrow B. Thus, the movement of the movable member 5 in the direction of the arrow C is allowed and the fastening screw 2 is now allowed to engage with the terminal fitting 4. Following these, the fastening screw 2 is tightened so that the fastening screw 2 is engaged with the terminal fitting 4 and the terminal member is fastened to the terminal connecting device 1.

Thus, in accordance with the present embodiment, after four terminal connecting devices 1 have been fastened to the terminal section 43 of the holding member 41, the substrate 31 is accommodated within the holding member 41 so that the slide portion 6a and 6b are respectively contacted with the terminals 32a and 32b of the substrate which are exposed to the outside through the fastening holes 45a and 45b, respectively. Thereafter, by for example soldering the slide portions 6a and 6b to the terminals 32a and 32b through the holes 45a and 45b, the terminal connecting device 1 can be electrically connected to the substrate 31 easily.

While the present embodiment has been described as applied to a photoelectric switch, the invention can be equally applied to any other small electric device including terminal sections.

I claim:

1. A terminal connector of a small electric device, comprising:

a printed substrate having electric circuitry arranged thereon and formed with at least one terminal at a predetermined location for electrically connecting the electric circuitry to external devices;

a holding member adapted to accommodate the substrate therein and including terminal sections for providing locations for connecting electric wires from the external devices to each of the terminals; and at least one terminal connecting device for fastening the electric wires, each said terminal connecting device being arranged in a respective said terminal section of the holding member and each including a fastening screw, a movable member for supporting the fastening screw, a terminal spring for movably and undetachably supporting the movable member, and a terminal fitting;

wherein the location of each said terminal formed on the substrate and the location of each said terminal connecting device are selected such that when the substrate is accommodated within the holding member and each said terminal connecting device is arranged in the holding member, a positional relation is attained whereby each said terminal on the substrate and a portion of each said terminal connecting device are in contact and connected electrically with each other.

2. A terminal connector of a small electric device according to claim 1, wherein the holding member includes at least one opening whereby a contacting portion of each said terminal formed on said substrate is exposed to the outside through a respective said opening and is soldered to a respective said terminal connecting device through the opening.

3. A terminal connector of a small electric device according to claim 1, wherein the portion of each said terminal connecting device adapted to contact one of said terminals on the substrate is a slide portion of the terminal spring and adapted to support the movable member.

4. A terminal connector of a small electric device according to claim 1, wherein the terminal fitting of each said terminal connecting device is inserted and arranged in place through a slit-like hole formed in side walls of the holding member, and the terminal spring, the movable member and the fastening screw are arranged in place through an opening formed in an upper part of the holding member.

5. A terminal connector of a small electric device according to claim 4, wherein an openable cover member is mounted over the opening formed in the upper part of the holding member.

6. A terminal connector of a small electric device according to claim 1, wherein the number of the terminals on the substrate is four, and the number of the terminal connecting devices is four.

7. A terminal connector of a small electric device according to claim 6, wherein said terminal connecting devices are formed into two groups of two, arranged at front and rear positions within the terminal sections of the holding member and wherein there is a difference in height between the front and rear positions.

* * * * *